United States Patent [19]

Genini

[11] 4,052,906

[45] Oct. 11, 1977

[54] MECHANISM FOR CONTROLLING THE MOTION OF THE WEFT CARRYING GRIPPERS IN LOOMS

[75] Inventor: Graziano Genini, Stabio, Switzerland

[73] Assignee: Albatex A.G., Vaduz, Liechtenstein

[21] Appl. No.: 665,335

[22] Filed: Mar. 9, 1976

[30] Foreign Application Priority Data

| | | |
|---|---|---|
| Mar. 10, 1975 | Switzerland | 2991/75 |
| Feb. 20, 1976 | Switzerland | 2071/76 |

[51] Int. Cl.[2] ..... F16H 25/12

[52] U.S. Cl. ..... 74/57; 74/89.15; 74/424.8 B

[58] Field of Search ..... 74/89.15, 424.8 B, 459, 74/57, 58

[56] References Cited

U.S. PATENT DOCUMENTS

| | | | |
|---|---|---|---|
| 590,929 | 9/1897 | Youngken | 74/89.15 |
| 2,718,165 | 9/1955 | Bourassa et al. | 74/424.8 B |
| 2,883,183 | 4/1959 | Finsterwalder et al. | 74/89.15 |
| 2,938,400 | 5/1960 | Gondek | 74/459 |
| 3,323,382 | 6/1967 | Ruschmann | 74/424.8 B |

*Primary Examiner*—Samuel Scott
*Assistant Examiner*—Wesley S. Ratliff, Jr.
*Attorney, Agent, or Firm*—Young & Thompson

[57] ABSTRACT

In a mechanism for controlling the motion of the weft carrying grippers in looms, the inlet movement is the rectilinear reciprocating motion of the small end of the final connecting rod of a linkage operated by the main shaft of the loom, and the outlet movement is the rotary reciprocating motion of a gearwheel controlling the straps for advancement of the grippers. The mechanism comprises a screw and a slider through which said screw passes, one of said elements being moved along a fixed rectilinear path by said connecting rod small end, while the other element is caused to rotate about its own axis, parallel to said path, to cause the rotation of said gearwheel. The mechanism comprises, further, rolling means, carried by said slider and being in engagement with the threading of said screw, to cause the rotation of one of said elements, as a function of the translation of the other element.

5 Claims, 9 Drawing Figures

Fig. 5
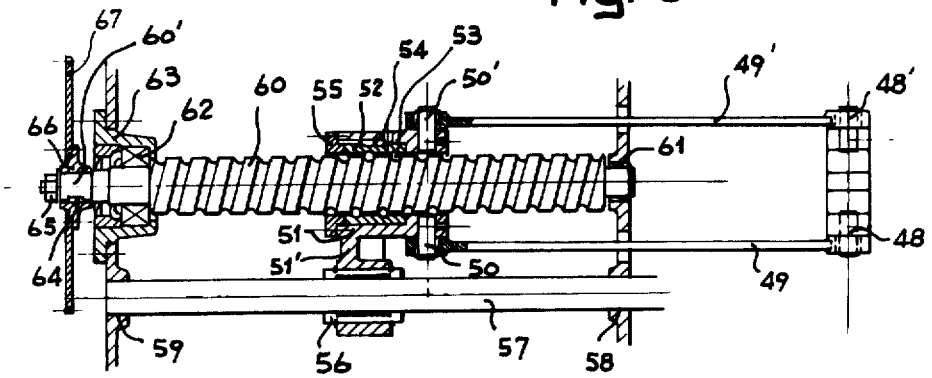
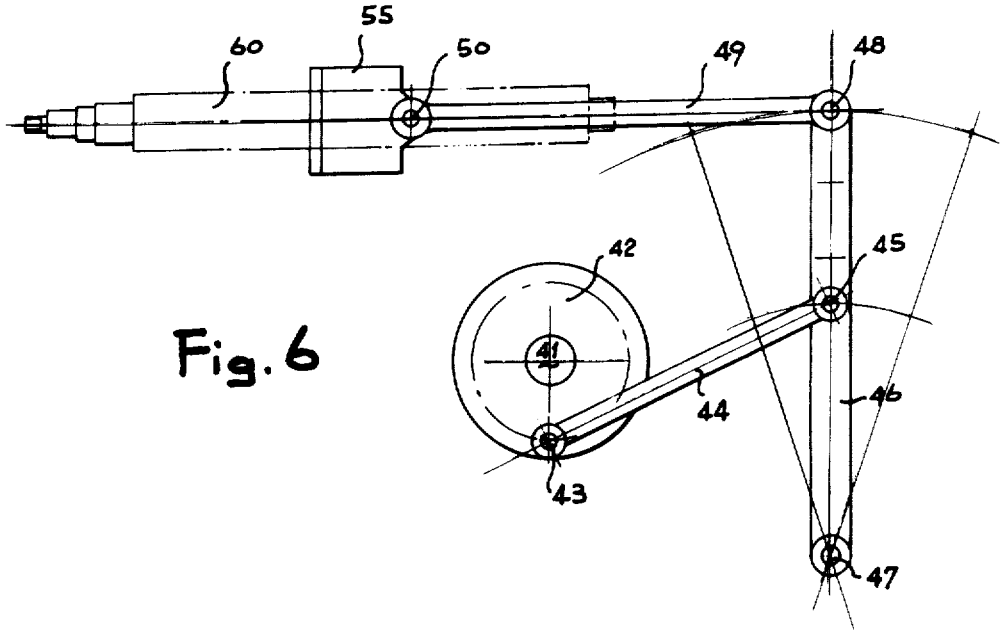
Fig. 6

MECHANISM FOR CONTROLLING THE MOTION OF THE WEFT CARRYING GRIPPERS IN LOOMS

BACKGROUND OF THE INVENTION

The present invention relates to a mechanism for controlling the working movement of the weft-carrying grippers in weaving looms with continuous weft feed, said mechanism providing remarkable advantages compared to the technical solutions so far adopted for this purpose.

As is known to those skilled in the art, it is very difficult to obtain — in continuous weft feed looms, using weft-carrying grippers which move forward and backward through the shed — a working movement of such grippers which may answer the many actual requirements, often in contrast with one another, having to be satisfied; and it cannot be said that the mechanisms controlling said movement, which have so far been provided by known techniques, are adopted to satisfactorily solve the various problems, which have to be faced by the manufacturers of weaving looms.

When undertaking the studies, which have led to the present invention, it seemed necessary to establish first of all which were the main requirements having to be satisfied by the mechanism for controlling the gripper movement, which had to be realized with more rational principles than in the past. Now that such a mechanism has been successfully conceived, it will be convenient to sum up said requirements hereunder, so that the characteristics and the scope of the present invention may be properly understood and correctly valued.

From the point of view of the gripper movement to be obtained, it is hence necessary:

to be able to limit the speed of the carrying gripper, at the instant when it grips the weft thread in proximity to one end of the shed;

to be able to limit the speed of the drawing gripper, at the instant when it abandons the weft thread in proximity to the end of the shed opposite to that in which the thread is being gripped;

for the grippers to be out of the shed, when the reed beat-up takes place;

for the grippers to enter the shed only when the latter, formed by the warp yarns, is sufficiently open (in order to prevent the grippers, wedging in among the stretched yarns, from causing breaks in the warp);

to reduce the accelerations of the grippers, in order to limit the tension of the weft thread during its insertion, and to further reduce the dynamic stresses on the mechanical members which control the movement of the grippers;

for the elastic yieldings and the slacks of the mechanism controlling the movement of the grippers to be as small as possible;

for the reciprocating motion masses of the heretofore specified mechanism — and hence the inertial loads and the vibratory phenomena deriving therefrom — to be as limited as possible.

In connection with this point, which is particularly important, it should not be frogotten that the essential condition for the correct working of continuous weft feed looms (without shuttles), is to be able to operate a precise weft thread exchange, between the carrying gripper and the drawing gripper, close to the center line of the fabric (at the center of the shed). Now, the slacks of the insertion mechanism and the elastic stretches due to the inertial loads acting on its members, determine an additional elastic elongation of the stroke of the grippers, in respect of the stroke which would be had if the mechanism were to be considered as perfectly rigid. This elastic elongation is obviously a function of the speed of the weaving machine; whereby, with the varying of the mechanism speed, varies the relative position of the carrying gripper in respect of the drawing gripper, close to the center line of the fabric, where the weft exchange takes place. Consequently, the difficulty arises of an exact adjustment — to be performed with the machine at a stop — of the grippers' stroke, in that it is necessary to reckon exactly the addtional elastic elongation of the stroke itself. If said reckoning is not correct, the grippers will end by performing — at a steady speed rate of the machine — a shorter or a longer stroke in respect to that which would determine the best weft exchange conditions; in the first case, the exchange may not take place or it may be faulty; in the second case, there may be a true and proper collision between the two grippers, with obviously disastrous consequences. The described phenomenon is particularly felt in the transient starting stage of the machine, since in this stage, the speed varies from naught to a steady speed rate, and with it varies also the additional elastic elongation of the grippers' stroke.

On the other hand, a rationally conceived mechanism for controlling the grippers' movement, has to satisfy requirements from the constructive and economical point of view, as well as from the point of view of practical industrial use, the main among said requirements being:

the possibility to weave, on a same loom, fabrics of different width; this requirement implies the need to be able to adjust — in an easy and quick way, and on a same loom — the distance moved by the grippers from one end to the other of their stroke;

the economical opportuneness for a single type of control mechanism to be suitable both for weaving machines adapted to weave only narrow fabrics, and for weaving machines adapted to weave fabrics of considerable width; and moreover, that a same mechanism of this type may be mounted on said different machines with the smallest possible number of modifications; if said requirement is satisfied, it is in fact possible to increase the range of looms being constructed, to reduce the planning, construction, storage and service expenses, and to achieve a greater standardization in the industry;

the opportuneness of having a noiseless mechanism. It is in fact known that, in the weaving machines of the type in question, the main cause for noise is provided by the weft insertion mechanism; whereby, the noise in weaving rooms is at present extremely high, and it is responsible for poor working conditions and for considerable psychophysical stresses on the operators;

the advantage of having a relatively small mechanism, allowing to limit the dimensions of the loom, and hence the space occupied by the same in weaving rooms;

the advantage of making a mechanism with a high mechanical efficiency, so as to reduce the electrical input of the weaving machine.

In general, the machanisms for controlling the working movement of the grippers, known so far, are made with articulated systems consisting of crank gears and linkages, or else with cams. The articulated systems have the considerable drawback of not being apt to provide the movement of the grippers with the desired characteristics, particularly as far as the acceleration of the grippers is concerned. The solutions with cams, so far adopted, provide for the use of cams which allow a limited stroke of the cam follower and hence demand a further amplification mechanism, to proportion the stroke of the cam follower to the stroke of the grippers.

In this case, there are considerable stresses on the cam follower roller contacting the cam surface profile; moreover, the amplifying mechanism — especially on machines adapted to weave the wide fabrics — introduces slacks and inertial masses in reciprocating motion, which increase the loads, limit the speed of the mechanism and cause highly troublesome noises.

The mechanism for controlling the grippers movement according to the present invention, is adapted to eliminate the various drawbacks of known mechanisms and to satisfy, in a very efficient way, all the requirements set forth hereabove, said mechanism adopting an original constructive arrangement for turning a rectilinear reciprocating motion into a rotary, also reciprocating motion.

SUMMARY OF THE INVENTION

This mechanism for controlling the movement of the grippers is of the type wherein, the inlet movement is the rectilinear reciprocating motion of the small end of the final connecting rod of a linkage operated by the main shaft of the loom, and the outlet movement is the rotary reciprocating motion of a gearwheel controlling the straps for advancement of the grippers, said mechanism being characterized by a screw and by a slider through which said screw passes, one of said elements being moved along a fixed rectilinear path by said connecting rod small end, while the other element is caused to rotate about its own axis, parallel to said path, to cause the rotation of said gearwheel; and by rolling means, carried by said slider and being in engagement with the threading of said screw, to cause the rotation of one of said elements, as a function of the translation of the other element.

In such a mechanism, the screw may be a cam screw with variable pitch, while the rolling means carried by the slider may comprise at least one pair of opposed rollers or wheels, freely rotating on their own axes. Alternatively, said screw and said slider may form or comprise the screw and the nut of a ball or needle screw.

In a first preferred embodiment, the mechanism according to the invention uses a double-start cam screw and a slider bearing four pars of wheels — arranged by twos facing each other — rotating on axes diverging towards the screw axis to the extent in which diverge the sides of the screw threads, said wheels being designed to roll on the tracks formed by the outer surface of said sides. Each of said pairs of wheels comprises two side-by-side wheels, freely rotatable on one of said axes. In this embodiment, the cam screw freely passes through the slider, which is provided, for the purpose, with a wide passage.

In a further embodiment of the mechanism according to the invention, — wherein an easy push fit is provided between the outer surface of the cam screw and the hold or the slider through which said screw passes — the slider bears two opposed frustoconical rollers, rotating on a common axis perpendicular to the screw axis, which rollers are designed to roll on the thread of the screw itself.

In a further preferred embodiment, the mechanism according to the invention comprises a screw, connected with the gearwheel controlling the straps and rotating about its own axis, and a slider which is moved by said connecting rod small end along a fixed rectilinear path parallel to the screw axis, said slider being innerly provided with at least one nut, said nut forming with said screw — together with a plurality of interposed balls — a ball screw.

In a still further embodiment of the present invention interposed balls — a ball screw.

In a still further embodiment of the present invention, the screw is moved by said connecting rod small end along a fixed rectilinear path, parallel to its own axis, while the slider may rotate, without translating, about the same axis and is connected with said gearwheel, said slider containing at least one nut which forms with said screw — together with a plurality of interposed balls — a ball screw.

BRIEF DESCRIPTION OF THE DRAWINGS

The invention is now described in further detail, by mere way of example, with reference to the accompanying drawings, which represent some preferred embodiments thereof, and in which:

FIG. 5 is the axial section view of a fourth embodiment of the mechanism according to the invention, of which FIG. 6 is a general side view; while FIG. 8 shows a fifth embodiment of the mechanism according to the invention, of which

DESCRIPTION OF THE PREFERRED EMBODIMENTS

Figure 1:
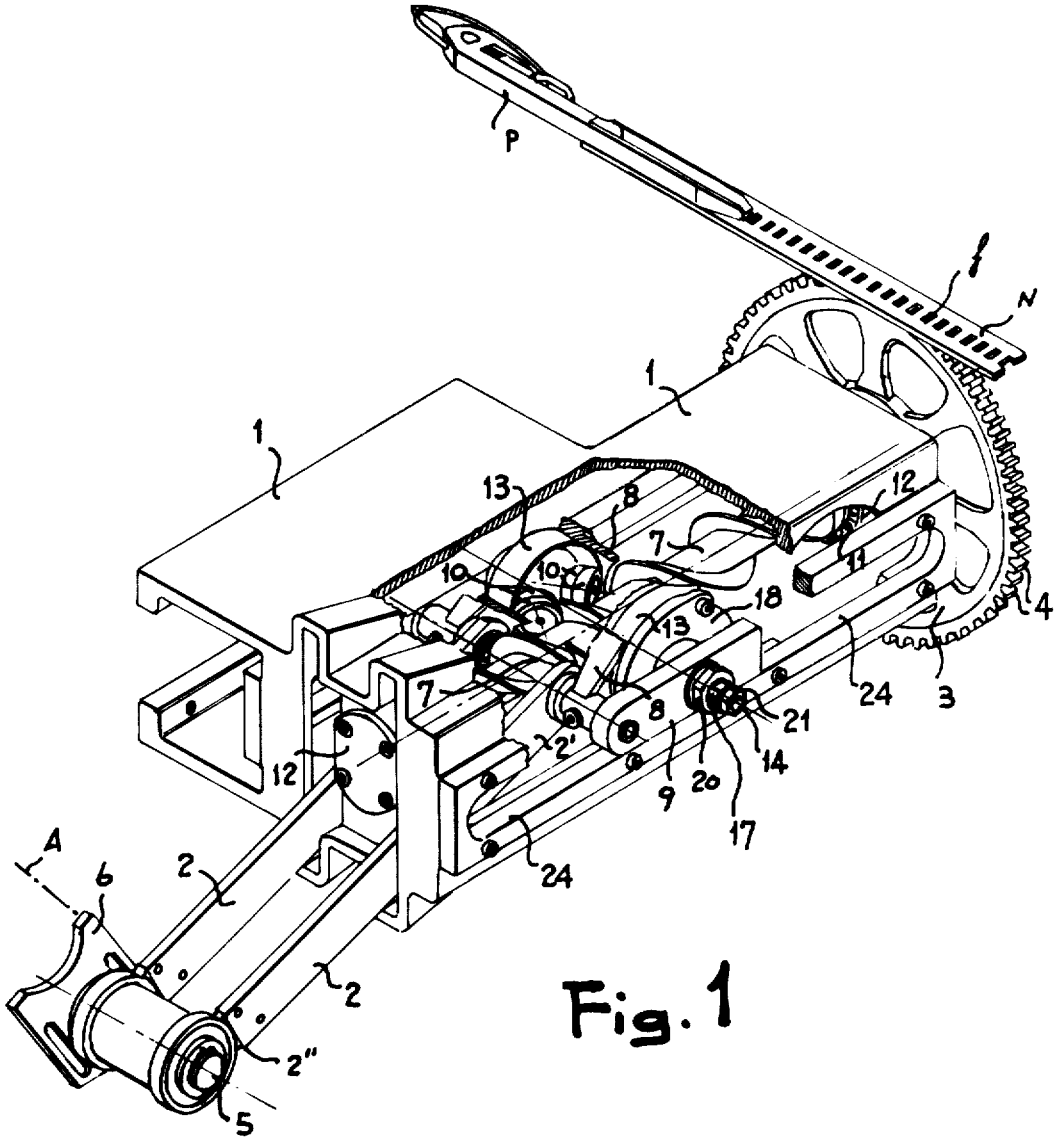
FIG. 1 is an axonometric general view — with some parts removed for further clearness of illustration — of a first preferred embodiment of the mechanism for controlling the working motion of the grippers in a weaving loom with continuous weft feed, according to the invention.
Figure 2:
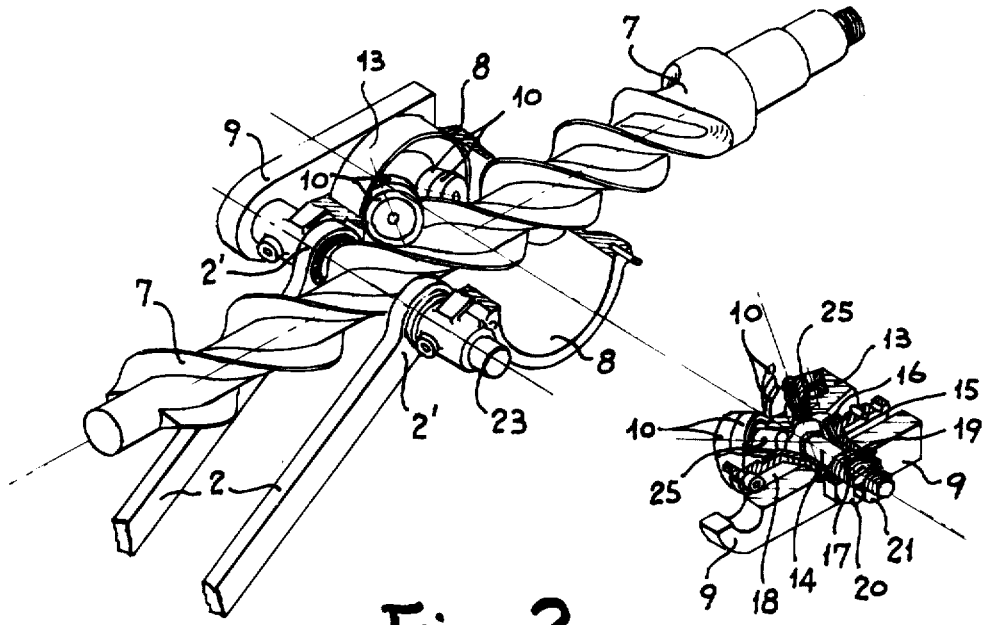
FIG. 2 is a view showing disassembled parts — with other parts removed or interrupted — of the arrangement by which, in the mechanism of FIG. 1, a rectilinear reciprocating inlet motion is turned into a rotary outlet motion.

With reference to FIGS. 1 and 2 of the accompanying drawings, the mechanism for controlling the forward movement of the grippers P in a weaving loom (not shown) with continuous weft feed, comprises a stout metal case 1, containing mechanical members for turning into a rotary motion the reciprocating rectilinear motion of the small end of a double connecting rod 2, which operates said members, and a gearwheel 3, which is caused to rotate in reciprocating motion motion by the same members and the teeth 4 of which, engaging the slits f of the strap N controlling the gripper P, cause the working movement thereof. The end 2',or small end, of the double connecting rod 2 is apt to move along only a rectilinear path, in reciprocating motion, while the other end 2'' of said double connecting rod 2 is pivoted on a crank pin 5 of a slide 6, mounted on a crank forming, with the connecting rod 2, a connecting rod-crank unit. The crank (not shown) with the slide 6 rotates about a shaft A — the axis of which is marked with dashes in FIG. 1 — which may be the main shaft of the weaving loom, or a secondary shaft rotating at the same speed as the main shaft. The position of the slide 6 may be radially changed on the crank, so as to vary the eccentricity of the crank mechanism, thus realized, in respect of the shaft A. In a known manner, this serves to adjust the length of the stroke of the connecting rod 2, and hence that of the gearwheel 3 and that of the gripper P. The position of the slide 6 is set with the loom at a stop, by any known mechanical means.

According to the invention, the members for turning the rectilinear reciprocating motion of the small end 2' of the connecting rod 2, into a rotary reciprocating motion of the gearwheel 3, essentially comprise, within the case 1: a cam screw 7, an end of which is keyed to the gearwheel 3 while the other end is mounted freely rotatable; a slider 8, through which passes said cam screw and which is moved parallel thereto by the action of the connecting rod 2, connected therewith at its end 2'; a pair of skids 9, connected to the slider 8 and sliding within guides of the case 1, said guides being parallel to the cam screw 7; and four pairs of freely rotatable wheels 10, engaged with the threading of the cam screw 7 and carried by said slider.

Going into further details, it can be noticed that the cam screw 7 is — in the embodiment being now described — a variable-pitch cam screw, that is, a cam screw with the inclination of its helix varying continuously along the axis; the equation which represents the variation law of the helix inclination, and hence of the screw pitch inclination, — as a function of the angular space described by the screw in its rotary motion about its own axis — has to be chosen as a function of the desired movement of the grippers, by considering — for the study of such equation — as inlet motion, the motion of the end 2' of the connecting rod 2, and as outlet motion, the motion of the gripper P, produced by the gearwheel 3, The cam screw 7 is a double-thread screw and it is supported at its ends by ball and/or roller journal-thrust bearings, as 11, housed in appropriate seats 12, provided in the case 1.

The slider 8 consists of a stout hollow body of light alloy, extending transversely to the cam screw 7 and being perforated, so as to freely let through said screw. Said slider 8 houses two opposed cylinders 13 which carry two pairs of wheels 10: such cylinders are arranged symmetrically, one on each side of the cam screw 7, each of said cylinders being provided with a threaded tie rod 14, integral therewith. The outer cylindrical surface of the tie rods 14 is enveloped by sleeves 15 comprising, at one end, pressure plates 16 contacting the wheels-carrying cylinders 13 and, at the other end, externally threaded cylindrical bearings 17, inserted into the caps 18 at the ends of the slider 8.

The caps 18 are fixed to the body of the slider 8 by screws and pins, and they house, in the inner threaded cavity of the extensions 19, the sleeves 15, while the two skids 9 are keyed on the outer surface of the caps 18 (said skids being arranged one on each side of the cam screw 7).

Nuts 20 are used to lock the sleeves 15 in respect of the caps 18, while nuts 21 are used to lock the tie rods 14, and hence the cylinders 13 carrying the wheels 10, in respect of the sleeves 15. It is thus possible to carefully adjust the position of the cylinders 13, and hence of the pairs of wheels 10, in respect of the axis of the cam screw 7.

The skids 9, of antifriction material, each comprise two keying holes of which, one envelops the outer surface of the tubular extension 19 of the cap 18, and the other envelops one of two pins 23, provided in the portion of the slider 8 facing the connecting rod 2. The skids 9 are arranged in rectilinear guides 24, fixed to the case 1 of the mechanism, wherein they may slide backwards and forwards. Pairs of pins 25 are rigidly fixed in the cylinders 13, said pins being arranged according to two diverging axes, having a relative angular distance equal to the angular distance between the two sides of the threads of the cam screw 7. On said pins 25 are mounted — idly rotating on suitable bearings — the pairs of side-by-side wheels 10, in a position suited for rolling on the tracks formed by the outer surfaces of the threads of the cam screw 7.

The double connecting rod 2 is connected to the slider 8 by pivoting the small end 2' of the connecting rod 2, on the pins 23 of the slider 8, to which are also connected the skids 9, as already seen.

The operation of the described mechanism takes place as follows: by rotation of the main shaft of the loom, the crank 5 is moved around the shaft 1, and the connecting rod 2 puts into motion the slider 8, to which it is pivotally connected in correspondence of the pins 23. Since the slider 8 is fixed to the skids 9 — which may only move backwards and forwards along the guides 24 — said slider will also be moved backwards and forwards on a rectilinear path, parallel to that of the guides 24 and hence to the axis of the cam screw 7. On the other hand, the movement of the slider 8 drives the pairs of wheels 10 into engagement with the threads of the cam screw 7, onto which they roll, causing the rotation of the cam screw 7 through the thrusts imparted thereon. The use of pairs of side-by-side wheels 10 — wherein each wheel idly rotates with its own motion law — reduces the slippage deriving from the cylindrical shape of the actual wheels. The rotation of the cam screw 7 will take place in one direction, due to the movement of the slider in one sense, and in the opposite direction, due to the movement of the slider in the other sense inside the guides 24. Corresponding rotations are directly imparted also to the gearwheel 3, which is keyed on the cam screw 7, and said rotations — due to the engagement of the teeth 4 with the slits f of the straps N — cause the to-and-fro movement of the actual straps N, and hence of the gripper P, as desired. The motion law of the gripper will depend on the motion law of the small end 2' of the connecting rod 2 (in turn influenced by the position of the slide 6) and on the pattern of the threading of the cam screw 7, which pattern — due to the requirements of weaving machines — will always and anyhow be with variable pitch.

Figure 3:
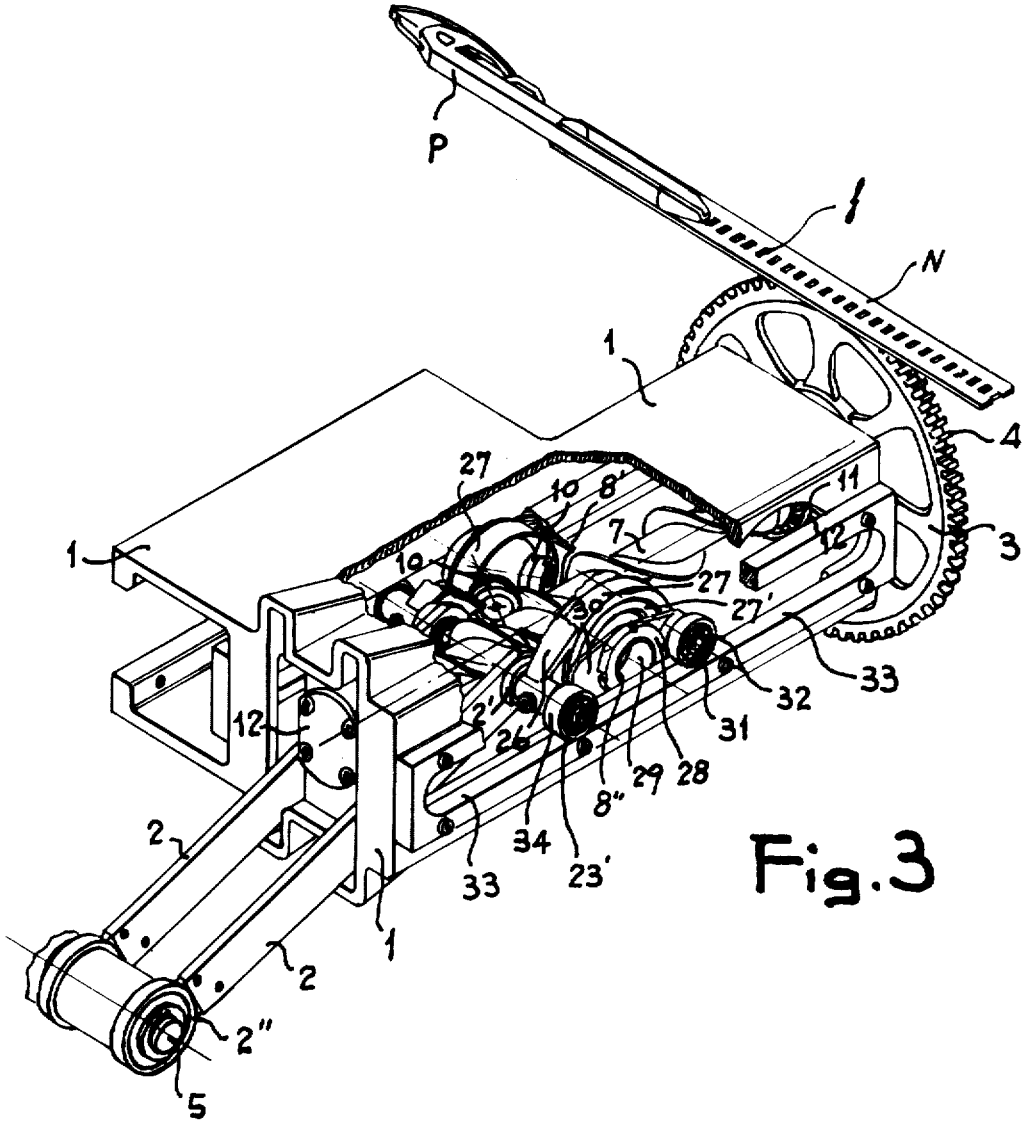
FIG. 3 is an axonometric view, similar to that of FIG. 1, showing a second embodiment of the mechanism according to the invention.

The embodiment of the mechanism according to the invention, shown in FIG. 3, provides for some modifications in the structure of the slider; this latter consists of a cylindrical hollow body 8' comprising, on one side, two transverse projections 26, in which are mounted the pins 23' for connection to the connecting rod 2, while the two ends 8'' of the slider are threaded. The slider body 8' further comprises two holes, aligned with the axis of the cam screw 7, for allowing the free passage of said cam screw. In the inner cavity of the slider 8' are housed two wheel-carrying discs 27, arranged symmetrically in respect of the cam screw 7. Each of said discs 27, (in which are mounted pairs of wheels 10

— in a similar way to that described with reference to the cylinders 13 of the previous embodiment — rotating on diverging axes and being engaged with the surfaces of the threads of the cam screw 7) is fixed to the slider 8' by a ring nut 27', which engages in an appropriate threaded seat of the slider and serves to preload the wheels 10 against the threads of the cam screw 7, and by a ring nut 28, which screws onto a threaded seat on the cylindrical bearing 29 of the wheels-carrying disc 27, and has the function of locking the disc itself in a given position. Between the ring nuts 27 and 28 is arranged at each end of the slider 8', a support 30, the ends of which bear on the outer part of the slider surface, and the central part of which is keyed onto the cylindrical bearing 29 of the wheels-carrying disc 27. To the support 30 is fixed a pin 31 onto which is keyed, by means of ball bearings, a contrast roller 32 adapted to slide by rolling into a guide 33 fixed to the case 1. In the same guides 33, wherein slide the rollers 32, are arranged — also for sliding by rolling — rollers 34, mounted on the pins 23' which connect the connecting rod 2 to the slider 8'.

The four contrast rollers 32 and 34, arranged two on each side of the slider, assure the rectilinear motion of the latter, under the control of the moving connecting rod 2.

There are no particular remarks to make in connection with the working of the mechanism of FIG. 3, which is substantially the same as that of the mechanism of FIGS. 1 and 2. It is instead important to observe that, in both embodiments described, the mechanism for controlling the working motion of the grippers according to the present invention, as well as obviously being fundamentally different from the known articulated crank and connecting rod mechanisms, also thoroughly differs from the cam mechanisms known so far, the reason being that, while in the known cam mechanisms the cam is moved by a shaft having a uniform circular motion, and the motion law of the cam follower is obtained through a cam profile extending at the most throughout a single round angle (360°), in the cam screw of the invention the inlet motion, instead of being provided by the uniform circular movement of a shaft, is provided by the reciprocating motion of the connecting rod small end and there are available, for cutting the cam profile, as many round angles as the number of pitches of the cam screw 7.

This allows to advantageously obtain a movement of the cam follower — which, in the device according to the invention, is formed by the slider 8 — having an amplitude which is definitely greater and more precise than that obtained with normal cams. The four pairs of wheels 10 are positively coupled with the profile of the threads of the cam screw 7, and any slack between the coupled parts is fully taken up by preloading — through adjustment of the caps 18 and of the ring nuts 27' and 28 — the wheels 10 against the surface of the threads of the cam screw 7.

Figure 4:
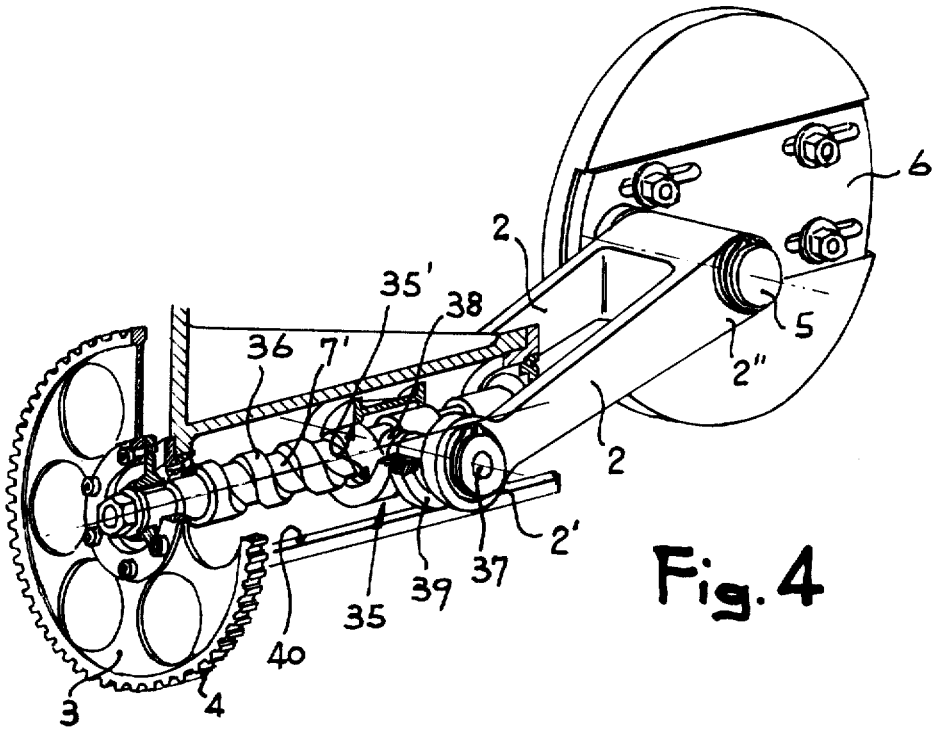
FIG. 4 is an axonometric partial view of a third embodiment of the mechanism according to the invention.

FIG. 4 illustrates the third preferred embodiment of the mechanism according to the invention. In this embodiment, the to-and-fro movement is imparted to a simplified slider 35, in an identical manner to that pointed out in connection with the sliders 8 and 8' of the heretofore described first and second embodiments of the mechanism. In this case, however, there is an easy push fit between the outer surface 36 of the cam screw 7 and the inner surface 35' of the slider 35, so as to prevent the rotation of the latter in a plane of the screw axis. The slider 35 — in the form of a cylindrical sleeve coaxial with the screw 7 — comprises two holes perpendicular to the axis of the screw itself, said holes housing two pins 37, arranged on a same axis perpendicular to the screw 7 and carrying at one end, a frustoconical roller 38 and, at the opposite end, a cylindrical bearing onto which are keyed the small end 2' of the control connecting rod 2, and a contrast roller 39.

Each roller 38, bound to idly rotate about its own pin 37, rolls on the surfaces of the grooves of the cam screw 7 with limited slippage, because of its frustoconical shape, and forces said cam screw to rotate.

The contrast rollers 39, arranged symmetrically, one on each side of the cam screw 7, prevent — by rolling on tracks or guides 40 — the rotation of the slider 35 in a plane perpendicular to the screw axis. The movement of the strap controlling the grippers is imparted, as in the previous cases, by the gearwheel 3 which is connected to the cam screw 7.

In FIGS. 5 and 6 of the drawings is illustrated a fourth embodiment of the invention. These figures show a crank 42, connected to the main shaft 41 of the machine and rotating with a uniform circular motion, said crank carrying the crank pin 43, on which is hinged an end of a connecting rod 44. The other end of the connecting rod 44 is hinged on the pin 45 of a rocking lever 46, which is in turn hinged on the pin 47, fixed to the case of the machine, and which is hence subjected to an oscillatory motion on rotation of the shaft 1, namely when the loom is in motion. The rocking lever 46 is fork-shaped at the end opposite to that fulcrumed on 47, and is hinged by means of two pins 48 and 48' on two connecting rods 49 and 49', which are pivoted at their other end to a slider 51 of the mechanism, by means of pins 50 and 50'. The slider 51 thus performs a reciprocating to-and-fro motion when the shaft 41 is rotating. The slider 51 comprises a hole, through which penetrates a screw 60, and a cavity coaxial with the axis of said hole, in which is housed a nut 52 which acts as guiding and retaining member for rolling bodies 53. In the figure, said rolling bodies 53 consist of balls, but they could equally consist of needles, and they are in contact with the threading of the nut 52 and with the threading of the screw 60.

The nut 52 is rigidly positioned in respect of the slider 51 through a normal coupling or key 54, and through a stop ring 55 fixed by screws on the body of the slider 51.

The slider is further provided with an extension 51', having a hole for rigidly housing an axial ball bearing 56, which engages on a splined and/or ground fixed shaft 57, the ends of which are keyed into holes 58 and 59 of the machine case.

The sliding connection between the axial sliding bearing 56 and the shaft 57 allows the slider to move only in the direction of the axis of the shaft 57 — said shaft being arranged parallel to the axis of the screw 60 — while it prevents the rotation of the slider itself. The screw 60 is supported at one end by the ball or needle bearing 61, housed in the machine case, and at the opposite end by the ball or roller journal-thrust bearing 62, housed in the casing 63, which is in turn fixed to the machine case by screws.

The end of the screw 60 carries, mounted in the bearing 62, a cylindrical and/or conical bearing 60', onto which is keyed — by means of a key 64 and a threaded pressure nut 65 — a hub 66, to which is screwed the gearwheel 67 controlling the straps moving the loom grippers.

The rolling bodies or contact balls 53 of the ball screw formed by the screw 60 and by the nut 52, receive from this nut (which is moved to-and-fro by the slider 51) thrusts, which they impart to the surface of the helical threading of the screw 60.

Owing to the inclination of the threading of the screw 60, each thrust imparted by the slider may be considered as resolved in a force directed according to the screw axis, and in a force perpendicular to said axis and acting according to a straight line, having a distance from said axis equal to that existing between the axis itself and the point of contact between the balls 53 and the threading surface of the screw 60. This last force determines the couple which generates the rotary motion of the screw 60.

The ball screw may be formed with two nuts, instead of one as illustrated; in this case, it is possible to conveniently adjust the slack between the screw and the nuts, by operating a pressure ring which varies the distance between the two nuts; this is particularly interesting, as it allows to take up — while using the mechanism — any slack which may be produced by wear of its components.

Figure 7:
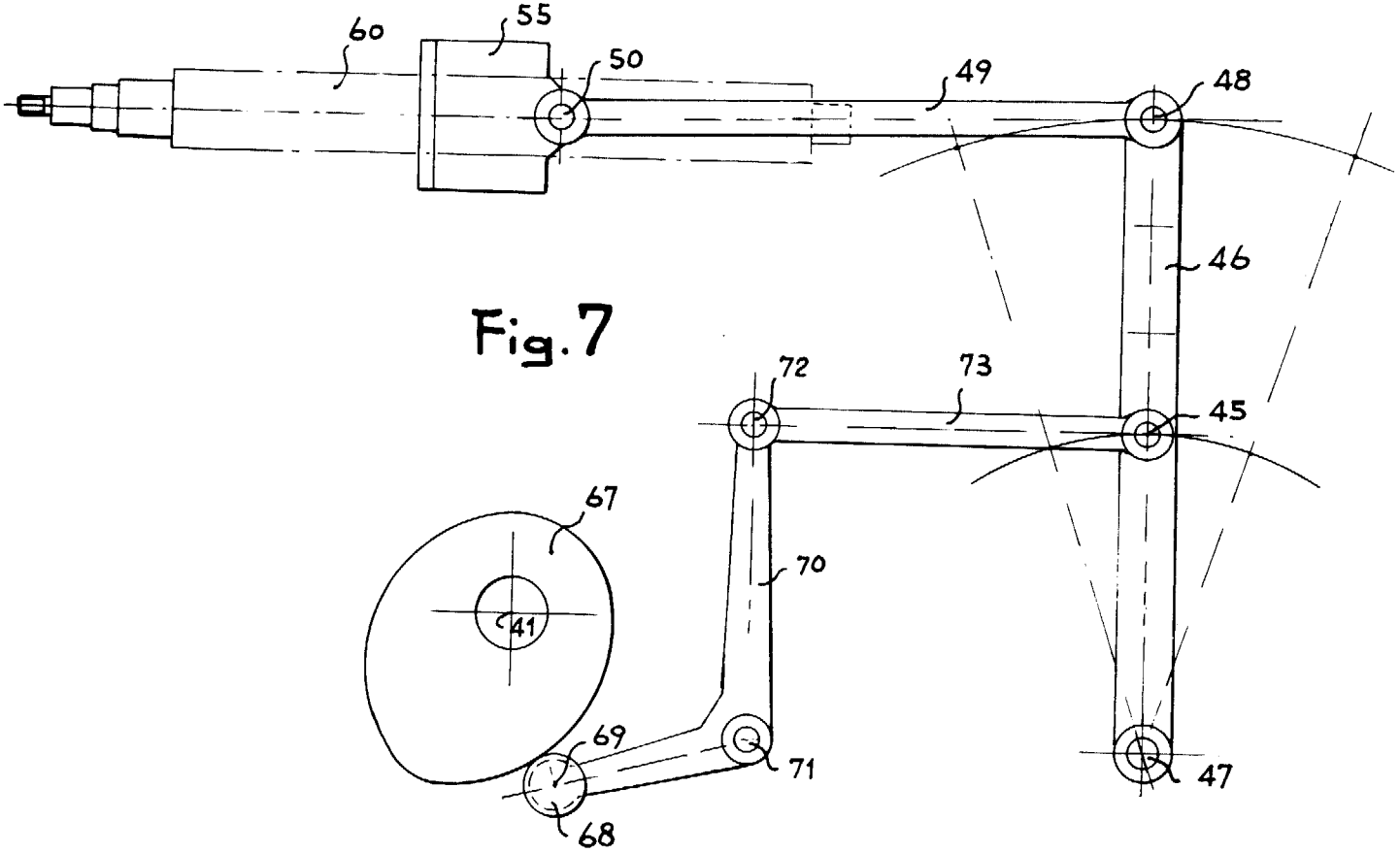
FIG. 7 is a modification of FIG. 6.

FIG. 7 shows a modification of the arrangement of FIG. 6; in said figure, the rocking lever 46 — instead of being controlled by a crank with connecting rod, as in FIG. 6 — is controlled by means of a cam 67, keyed on the main shaft 41 of the machine. A roller 68 is engaged with the surface of said cam 67 and rotates about its own axis 69, which is placed at the end of a rocking lever 70, pivoted on 71. A connecting rod 73 is hinged, on 72, to the other end of the rocking lever 70, said connecting rod imparting an oscillatory movement to the rocking lever 46, with a law depending on the pattern of the rocking lever 46, with a law depending on the pattern of the cam 67.

Figure 8:
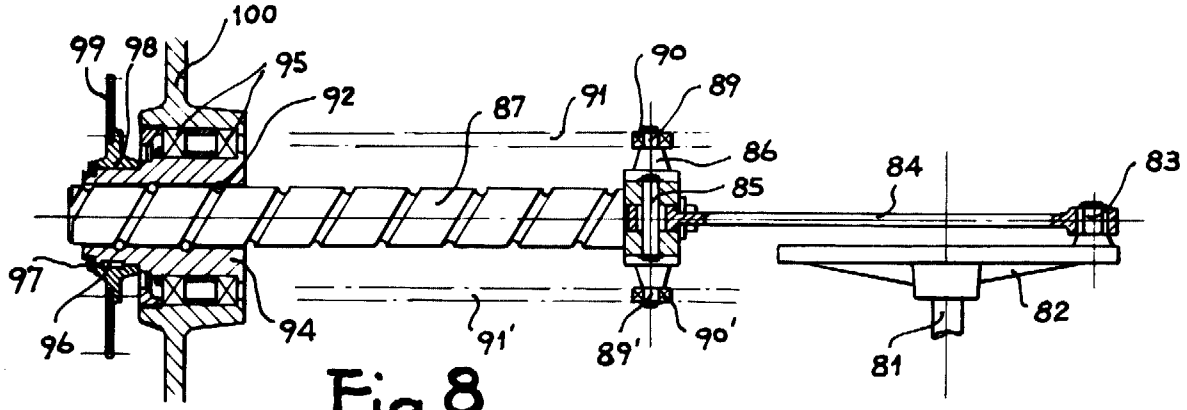
Figure 9:
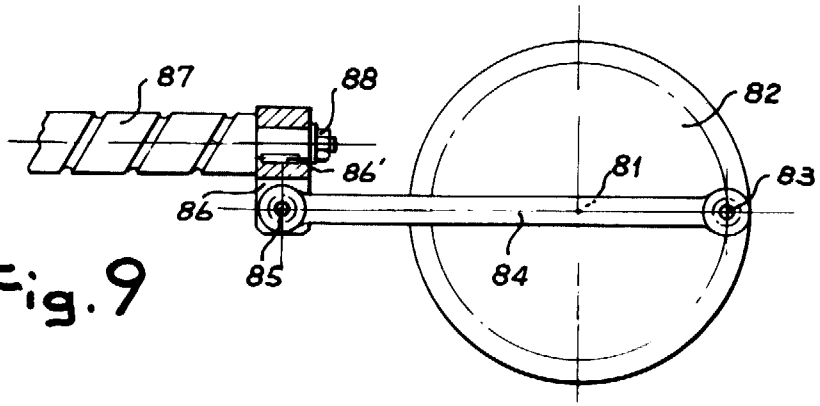
FIG. 9 is a partial side view.

With reference, now, to FIGS. 8 and 9 of the accompanying drawings, the embodiment shown therein differs from the one previously described, due to the fact that — instead of providing for a nut having a rectilinear reciprocating motion and a screw having a rotary reciprocating motion — it comprises a screw to which is imparted a rectilinear reciprocating motion, and a nut which is caused to rotate. Evidently, in this case, the nut is connected to the gearwheel controlling the straps carrying the loom grippers. Going into details, a crank 82 — which is rigidly keyed, at 81, onto the main shaft of the loom — carries, hinged on the crank pin 83, an end of a connecting rod 84, the opposite end of which is hinged on the pin 85 of a slider 86. Said slider 86 is rigidly keyed — by means of a key 86' and a threaded nut 88 — onto a screw 87 which forms, together with a nut 94, the ball screw mechanism of the device. The slider 86 comprises two cylindrical extensions 89 and 89', which carry two wheels or skids 90 and 90', sliding on guides 91 and 91' of the machine case 100.

The screw 87, provided with a rectilinear reciprocating motion in the direction of its axis, determines — through the interposition of rolling bodies 92 (balls or needles) — the rotary reciprocating motion of the nut 94, which is supported by the bearings 95 housed in the machine case 100. A cylindrical bearing of said nut 94 supports the hub 98 of the gearwheel 99, for controlling the gripper-carrying straps in known manner, said hub 98 being fixed by means of the key 96 and of the ring nut 97.

As can be easily seen, upon examining the drawings and on reading the previous description, the mechanism according to the present invention is smaller, more precise, lighter and far less noisy than the common mechanisms used so far on automatic weaving machines; moreover, it works more rapidly and with high mechanical efficiency, and the slacks, accelerations and inertial masses are reduced to a minimum.

It fully satisfies all the requirements pointed out in the early part of the present specification and, in particular, it reduces to minimum values the additional elastic elongation of the gripper stroke, allowing an easy adjustment of the length of the stroke itself.

In the embodiments of FIGS. 1 to 4, the mechanism according to the invention provides the considerable advantage of not being conditioned by the fact of having to perform only one particular type of movement of the grippers; in fact, any time that — for reasons connected with the planning or testing, or with the type of work, or any other reasons — a change of the grippers motion law is required, it is not necessary to completely change the mechanism — as would be the case with all the so far known mechanisms for controlling the gripper motion — but it is sufficient to replace a single piece (after having eventually studied and appropriately realized the same), namely the cam screw of the device, in order to obtain the motion deemed most convenient. This possibility may be used even further by the manufacturer wanting to supply customers who, for the characteristic weaving of some manufactures, were to require motion laws satisfying characteristics other than the normal ones.

It is also easy to understand how it may be possible, with the same mechanism, to start the production of a single type of mechanism for controlling the grippers forward movement, to be used on very many types of weaving looms, meant for various types of manufactures and for weaving fabrics of different widths, with the mere condition of using, for each intended purpose, a different and appropriate type of cam screw, wherein the pattern of the variable pitch threading is designed according to the specific requirements for each application.

Further important advantages can be obtained with the mechanism according to the invention, when said mechanism is made by using — as in the embodiments of FIGS. 5 to 9 — a ball screw or a needle screw.

As known, a ball screw — already being widely used on machine tools (especially of the type with numerical control), but never used so far in mechanisms for weaving looms — is essentially formed by a threaded rod, rotating on balls or on needles held between said rod and a nut surrounding the same inside a helical channel, formed by a hardened track, resulting from the screw threading, and by a groove, also hardened, inside the nut.

A great number of balls (or needles) circulates inside said helical channel, which balls, after having come into working contact with the screw, are brought back from one end to the other of the nut, through a return duct. The balls (or needles) form the only contact between the screw and the nut, and they undergo no stress whatever while passing through the return duct.

The advantages that a transmission of this type may provide in controlling the motion of grippers in weaving looms — that is, in an application wherein the stresses are particularly high — are quite evident. In fact, in ball screws, a large number of contact rolling bodies are available, and there is hence a more regular distribution of the loads and a more limited pressure value onto each contact body. The high coupling efficiency (over 95%) is such that the conversion of the force acting on the nut in the couple acting on the screw, or viceversa, determines a limited friction work, and hence very little frictional heating. Moreover, the cooling of the contact balls may be achieved quite efficiently; this is due to the fact that, when returning through the outer ducts of the nut, the balls are unloaded and the nut ducts may easily be refrigerated by means of lubircating oil.

It is to be understood that the described embodiments of the device have been provided by mere way of example and that they hence introduce no limitation, while embodiments other than those described, or modifications of the ones already illustrated, may easily be conceived by those skilled in the art, without thereby departing from the scope of the present invention.

It is also to be understood that the mechanical arrangement — by which the rectilinear reciprocating motion of the connecting rod small end, in the mechanism according to the invention, is turned into the rotary reciprocating motion of the wheel acting on the strap — could be adopted in any other application (besides the control of the grippers' motion in weaving looms with continuous weft feed) for which it proved to be convenient. For example, such an arrangement could be advantageously adopted for the motion of some members in machine tools.

I claim:

1. Mechanism for controlling the motion of weft carrying grippers in continuous weft feed looms, comprising a main rotary shaft of the loom, a crank carried by said shaft, a connecting rod pivotally secured to the crank, a slider pivotally connected to the end of the connecting rod remote from the crank, a screw passing through said slider and fixed at one end to a gear wheel that rotates in opposite directions to advance and retract a weft-carrying gripper, said screw being a cam screw with variable pitch that rotates about its own axis, means mounting said slider only for rectilinear motion parallel to the screw, and at least one pair of opposed rollers or wheels mounted for rotation on said slider about axes that are fixed relative to the slider, said slider wheels or rollers engaging said variable pitch screw to rotate said gear wheel with variable angular velocity upon rotation of said shaft.

2. Mechanism as claimed in claim 1, said slider having thereon four pairs of said slider wheels or rollers arranged in pairs facing each other and rotating on axes diverging toward the screw axis at the same angle that the sides of the screw threads diverge.

3. Mechanism as claimed in claim 1, and means to adjust the positions of the slider wheels or rollers to regulate their engagement with the threads of the screw.

4. Mechanism as claimed in claim 1, said screw being a double-thread screw.

5. Mechanism as claimed in claim 1, and means preventing rotation of said slider about the axis of said screw, said preventing means comprising guide surfaces disposed on opposite sides of said screw and lying in planes parallel to the axis of pivoting of said connecting rod to said slider.

* * * * *